US005100463A

United States Patent [19]

Harker

[11] Patent Number: 5,100,463

[45] Date of Patent: Mar. 31, 1992

[54] METHOD OF OPERATING AN ELECTRON BEAM FURNACE

[75] Inventor: Howard R. Harker, Malvern, Pa.

[73] Assignee: Axel Johnson Metals, Inc., Lionville, Pa.

[21] Appl. No.: 555,911

[22] Filed: Jul. 19, 1990

[51] Int. Cl.[5] ..... C22B 4/00

[52] U.S. Cl. ..... 75/10.13; 219/121.17; 219/121.35; 373/10; 164/494

[58] Field of Search ..... 75/10.13; 373/10; 219/121.16, 121.17, 121.12, 121.35; 164/469, 494

[56] References Cited

U.S. PATENT DOCUMENTS

| | | | |
|---|---|---|---|
| 3,005,859 | 10/1961 | Candidus | 219/121.16 |
| 3,211,548 | 10/1965 | Scheller et al. . | |
| 3,342,250 | 9/1967 | Treppschuh et al. | 75/10.64 |
| 4,027,722 | 6/1977 | Hunt | 266/208 |
| 4,482,376 | 11/1976 | Tarasescu et al. . | |

*Primary Examiner*—Melvin J. Andrews
*Attorney, Agent, or Firm*—Brumbaugh, Graves, Donohue & Raymond

[57] ABSTRACT

In the representative embodiment described in the specification, an electron beam furnace has an evacuation system which maintains the interior of the furnace at a pressure in the range from about 50 microns Hg to 300 microns Hg. The relatively high pressure reduces degassing time from a cold start, suppresses volatilization of constituents of metal being refined, and causes volatilized metal to condense in powder form on a condensing screen. A vibrator assists in removing the powder from the condensing screen. The electron beam gun has a series of compartments which are individually evacuated to maintain the pressure in the compartment containing the cathode at a level less than about 1 micron Hg.

3 Claims, 1 Drawing Sheet

METHOD OF OPERATING AN ELECTRON BEAM FURNACE

BACKGROUND OF THE INVENTION

This invention relates to electron beam furnaces for vacuum refining of metals and metal alloys.

In vacuum refining of metallic materials such as titanium alloy, a feedstock, which may be scrap metal, is supplied to a cold hearth maintained at a vacuum and heated by application of energy from plasma torches or electron beam guns to melt the metal and separate impurities by vaporization, dissolution or gravity. Desired proportions of alloying constituents are also included in the raw material so that, when the molten metal is poured from the hearth into a mold to form an ingot, he ingot has a predetermined alloy composition.

Conventional furnace arrangements, however, present substantial difficulties in the refining of such alloys. Cold hearth furnaces using electron beam energy sources require a high vacuum on the order of 0.1–1 microns Hg in the gun region to prevent rapid deterioration of the cathode and filament in the electron beam guns. When molten metal mixtures are maintained at such high vacuum, however, necessary alloying constituents may be vaporized to an undesired extent, requiring adjustment of the content of those constituents in the raw material supplied to the furnace. Furthermore, in order to attain such high vacuums, substantial degassing times, on the order of five or more hours, are required upon start-up of a furnace from the cold condition. In addition, at such high vacuums, the vaporized constituents or impurities tend to form a loose coating or crust on the interior walls of the furnace and relatively large pieces of the coating may separate from the walls and fall back into the molten material, contaminating it to vary the composition from the desired value and forming undesired inclusions in the cast ingot.

On the other hand, furnaces provided with plasma guns as energy sources are normally operated at higher pressures, such as 100 microns Hg or more, and are less efficient when operated at lower pressures. Because of the higher-pressure conditions prevailing in furnaces using plasma guns as energy sources, refining which requires vaporization of relatively low-volatility impurities is not possible. The higher pressures prevailing in plasma furnaces, however, tend to suppress volatilization of desired alloy constituents, thereby avoiding the necessity for adjusting the raw material mixture to compensate for volatilization of components.

Moreover, at pressures above about 100 microns Hg, volatilized materials tend to condense on the walls of the furnace in the form of fine powders, as described, for example, in the Scheller et al. U.S. Pat. No. 3,211,548. The deposited powders can easily be removed from the walls by applying physical agitation, for example, by using vibrators, and they are readily remelted if returned to the molten metal in the hearth so as to eliminate the possibility of undissolved inclusions.

The Hunt U.S. Pat. No. 4,027,722 proposes to take advantage of the desirable aspects of both electron beam furnaces and plasma furnaces by providing successive melting, refining and casting stages which are maintained at different vacuum levels. For this purpose, however, Hunt requires several compartmentalized sections and provides different energy sources such as plasma guns for relatively high-pressure sections and electron beam guns for high-vacuum sections. The Tarasescu et al. U.S. Pat. No. 4,482,376, on the other hand, seeks to provide a plasma gun furnace having the advantages of relatively high vacuum obtained in an electron beam furnace by utilizing a specially-designed large-area plasma gun and operating in the range of 10–100 microns Hg.

SUMMARY OF THE INVENTION

Accordingly, it is an object of the present invention to provide a new and improved process for melting and refining metallic compositions which overcomes the above-mentioned disadvantages of the prior art.

Another object of the invention is to provide an electron beam refining method which prevents or inhibits vaporization of desired constituents of the composition during refining and casting.

A further object of the invention is to provide an electron beam furnace capable of melting and refining metallic compositions without undesired vaporization of components of the composition.

Still another object of the invention is to provide an electron beam furnace in which the start-up time is substantially reduced.

An additional object of the invention is to provide an electron beam furnace in which vaporized metallic constituents can condense on the furnace walls in powder or granular form.

These and other objects of the invention are attained by providing an electron beam furnace capable of operation at relatively high pressure of at least 50 microns Hg, desirably in the range from about 50–300 microns Hg, and, preferably, in the range of 100–200 microns Hg. In this way, electron beam refining of raw material may be carried out while suppressing volatilization of desired components of the material and avoiding accumulation of vaporized material on the walls of the furnace in a form in which relatively large pieces could fall from the walls into the molten material and cause contamination.

In order to assure proper operation of the electron beam guns in a furnace operating at increased pressure in the range of 50–300 microns Hg, for example, electron beam guns are designed to avoid deterioration of the filaments and cathodes which would result from operation at high pressure. In one embodiment, the electron beam guns are formed with a series of compartments through which the electron beam passes, and each of the compartments is evacuated separately so as to maintain an appropriate total reduction in pressure between the interior of the furnace and the location of the cathode and filament in the electron beam gun.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENT

Figure 1:
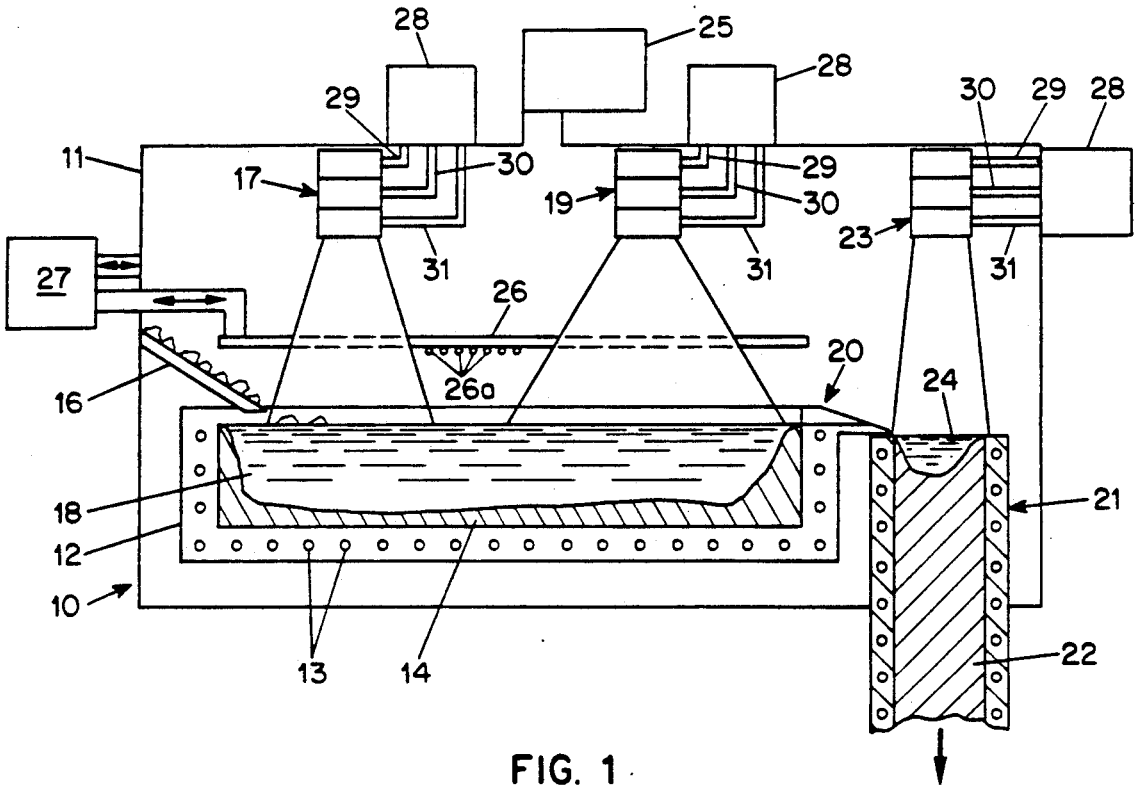
FIG. 1 is a schematic view illustrating a representative electron beam furnace arranged to operate at increased pressure in accordance with the present invention.

In the representative embodiment of the invention shown schematically in FIG. 1, an electron beam furnace 10 includes a housing 11 enclosing a hearth 12 which is cooled in the usual manner by internal water circulation conduits 13 to form a solid skull 14 of the material being refined. Pieces of solid raw material to be refined are supplied to the hearth through a feed chute 16 in the usual manner. The raw material deposited in the hearth is melted by an electron beam from an electron beam gun 17 which is scanned over a desired hearth area in the customary way to provide a pool of molten material 18 in the hearth.

Alternatively, if desired, the raw material supplied to the furnace may be in the form of a solid bar or electrode (not shown), having one end which is melted by the beam from the gun 17, the bar being moved toward the beam as the end is melted in the usual manner.

Another electron beam gun 19 is similarly scanned over another hearth region to impart energy to the pool of molten metal to assure that all particulate material is thoroughly melted, after which the molten material passes through a pouring lip 20 at the outlet end of the hearth to a vertical mold 21 in which the molten material is solidified into an ingot 22 which is withdrawn downwardly from the mold in the conventional procedure. A further electron beam gun 23 is scanned over the surface of the molten material 24 in the mold to impart sufficient energy to the material to assure proper solidification conditions.

In accordance with the invention, the interior of the housing 11 is maintained at a pressure above the normal range of pressures for an electron beam furnace, such as at least 50 microns Hg, desirably 100–300 microns Hg, and preferably 100–200 microns Hg, by a primary vacuum system 25. The primary vacuum system 25 includes a high-vacuum pumping arrangement as well as a controlled gas-bleed arrangement to bleed inert gas into the furnace interior when required to maintain the internal furnace pressure at a desired value.

With this arrangement, volatilization of desired constituents in the molten material 18 is suppressed because of the relatively high pressure and any metal which does volatilize during the processing tends to condense in the form of a fine powder.

In order to reduce losses of volatile constituents, the furnace 10 includes a horizontal condensing screen 26 positioned above the hearth, having appropriate openings for the electron beams, to condense and collect vaporized material in the form of a powder **26*a* before it reaches the furnace walls. To continuously remove the powder 26*a* from the screen 26 as well as any powder deposited on the furnace walls, a vibrator 27 imparts a vibratory motion to the screen and the housing walls, causing the deposited powder to be separated and fall back into the hearth 12. Since the deposit is in the form of fine powder, the material which falls back into the hearth is readily melted and does not form solid inclusions which could degrade the quality of the ingot 22**. Alternatively, scrapers (not shown) may be arranged to scrape the screen surface periodically.

Moreover, because the pressure in the hearth is one to two orders of magnitude higher than the pressure normally maintained in an electron beam furnace, the time required to degas the furnace upon initial start-up from the cold condition is substantially reduced. If the pressure in the furnace during operation were required to be maintained at 0.1–1 microns Hg, for example, degassing times of five to ten hours might be required before the furnace could be used. Since the furnace of the invention is operated at a substantially higher pressure, for example, in the range from 50–300 microns Hg, degassing requires substantially less time, for example, about one hour or less, on start-up from a cold condition, permitting the furnace to be operated much more quickly after a shutdown.

Figure 2:
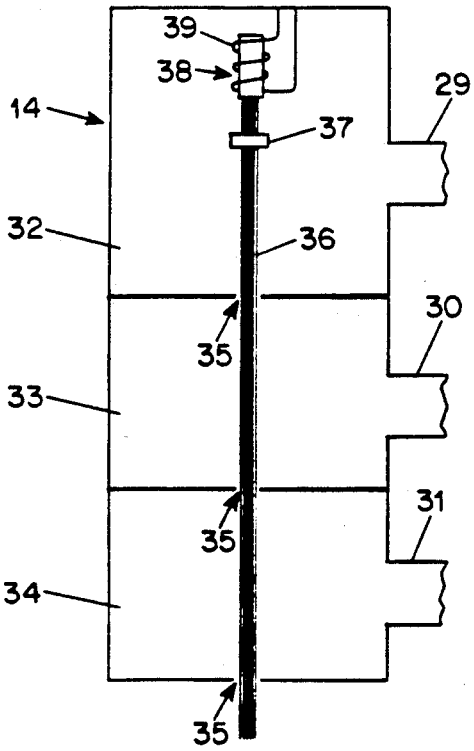
FIG. 2 is a schematic sectional view illustrating a representative arrangement for an electron beam gun intended for use in a furnace operated at increased pressure in accordance with the invention.

In order to avoid degradation of the cathodes in the electron beam guns 17, 19 and 23 when the furnace is operated at such increased pressure, each of the guns has a separate evacuation system 28 connected through three conduits 29, 30 and 31 to different portions of the gun housing. As illustrated in the enlarged schematic view of the electron beam gun 14 shown in FIG. 2, each of the guns is provided with three substantially isolated compartments 32, 33 and 34 which are joined by aligned openings 35 having the minimum size necessary to permit passage of an electron beam 36 from a cathode 37 in the compartment 32 through the compartments 33 and 34 to the exterior of the electron beam gun. The cathode 37 is heated in the conventional way by electrons emitted from an adjacent electron source 38 heated by a filament 39, causing emission of a high-intensity beam of electrons from the cathode 37. At pressures above about 1–10 microns Hg, however, both the cathode 37 and the filament 39 are degraded and destroyed by bombardment with atmospheric ions.

Accordingly, the pump 28 is operated so that the compartment 32 of the electron beam gun is maintained by evacuation through the conduit 29 at a pressure in the range from, for example, 0.1–1 microns Hg, and atmospheric molecules from the higher-pressure environment of the furnace which enter the gun chambers 33 and 34 through the corresponding apertures 35 are exhausted through the conduits 30 and 31, respectively, which are designed to maintain those chambers at intermediate pressures, such as, for example, 1–10 microns Hg and 10–100 microns Hg, respectively. The electron beam gun 14 is otherwise conventional in structure and contains the usual accelerating, focusing and deflecting arrangements, which are not shown in the drawing. Similar evacuation arrangements are provided by the corresponding pumping systems 28 for the other electron beam guns 19 and 23.

As a result, the advantages of relatively high-pressure operation, in the range from 50–300 microns Hg, of a refining furnace are obtained concurrently with the advantages of electron beam furnace operation, while avoiding the problems of degradation of the electron beam gun components which occurs at higher pressures.

Although the invention has been described herein with reference to a specific embodiment, many modifications and variations therein will readily occur to those skilled in the art. Accordingly, all such variations and modifications are included within the intended scope of the invention.

I claim:

1. A method for operating an electron beam furnace having an interior and having an electron beam gun with a cathode region comprising controlling the pressure within the furnace interior to provide a pressure of at least about 50 microns Hg and separately controlling the pressure in the cathode region of the electron beam gun at a level below about 10 microns Hg.

2. A method according to claim 1 including controlling the pressure within the furnace to provide a pressure in the range from about 100 microns Hg to about 200 microns Hg and controlling the pressure in the cathode-region of the gun to provide a pressure below about 1 micron Hg.

3. A method according to claim 1 including the step of bleeding gas into the furnace to control the pressure in the furnace.

* * * * *